US010626577B2

(12) United States Patent
Azzolin et al.

(10) Patent No.: US 10,626,577 B2
(45) Date of Patent: Apr. 21, 2020

(54) HYDRAULIC EQUIPMENT FOR EXCAVATORS AND OPERATING MACHINES IN GENERAL

(71) Applicant: MECCANICA BREGANZESE S.P.A. IN BREVE MB S.P.A., Fara Vicentino (IT)

(72) Inventors: Diego Azzolin, Breganze (IT); Guido Azzolin, Breganze (IT)

(73) Assignee: MECCANICA BREGANZESE S.P.A. IN BREVE MB S.P.A., Fara Vicentino (IT)

( * ) Notice: Subject to any disclaimer, the term of this patent is extended or adjusted under 35 U.S.C. 154(b) by 74 days.

(21) Appl. No.: 15/554,797

(22) PCT Filed: Mar. 4, 2016

(86) PCT No.: PCT/IB2016/051223
§ 371 (c)(1),
(2) Date: Aug. 31, 2017

(87) PCT Pub. No.: WO2016/139629
PCT Pub. Date: Sep. 9, 2016

(65) Prior Publication Data
US 2018/0044889 A1 Feb. 15, 2018

(30) Foreign Application Priority Data
Mar. 4, 2015 (IT) ..... 102015000007543

(51) Int. Cl.
*E02F 9/22* (2006.01)
*E02F 3/42* (2006.01)
(Continued)

(52) U.S. Cl.
CPC ..... *E02F 9/22* (2013.01); *E02F 3/246* (2013.01); *E02F 3/3681* (2013.01); *E02F 3/42* (2013.01);
(Continued)

(58) Field of Classification Search
CPC ..... E02F 9/2203; E02F 9/2217; E02F 9/2225; E02F 9/22; E02F 9/0883; E02F 3/246; E02F 3/3681; E02F 3/42; F15B 11/0445
(Continued)

(56) References Cited

U.S. PATENT DOCUMENTS 2,961,829 A * 11/1960 Weisenbach ..... F16H 39/00 60/454
4,211,252 A * 7/1980 Pezzini ..... B66C 3/16 137/580
(Continued)

FOREIGN PATENT DOCUMENTS

| | | |
|---|---|---|
| EP | 1361322 | 11/2003 |
| WO | 90/02848 | 3/1990 |
| WO | 2010/078887 | 7/2010 |

OTHER PUBLICATIONS

ASME, "Graphic Symbols for Fluid Power Diagrams", 1967.*
(Continued)

*Primary Examiner* — Nathaniel E Wiehe
*Assistant Examiner* — Richard C Drake
(74) *Attorney, Agent, or Firm* — Stradley Ronon Stevens & Young, LLP

(57) ABSTRACT

Hydraulic equipment of the type that can be fixed to a moving arm of an operating machine. The equipment has a support structure connected or connectable to a moving arm of an operating machine, at least one hydraulic motor for the rotation of a working element, a feed pipe connected or connectable to a hydraulic circuit of the supporting operat-
(Continued)

ing machine to supply a flow of working fluid to the hydraulic motor, and a drainage unit for the drainage of working fluid from the hydraulic motor. The equipment may optionally include a pressure detector in the drainage unit and a shut-off valve operationally associated with the pressure detector in such a way as to interrupt the flow of working fluid to the hydraulic motor when predetermined pressure conditions are detected.

20 Claims, 6 Drawing Sheets

(51) Int. Cl.

| | |
|---|---|
| ***E02F 9/08*** | (2006.01) |
| ***F15B 1/04*** | (2006.01) |
| ***F15B 13/02*** | (2006.01) |
| ***F15B 21/00*** | (2006.01) |
| ***E02F 3/24*** | (2006.01) |
| ***E02F 3/36*** | (2006.01) |

(52) U.S. Cl.
CPC ..... *E02F 9/0883* (2013.01); *E02F 9/2203* (2013.01); *E02F 9/2217* (2013.01); *E02F 9/2225* (2013.01); *F15B 1/04* (2013.01); *F15B 13/02* (2013.01); *F15B 21/005* (2013.01)

(58) Field of Classification Search
USPC ..... 60/459, 455
See application file for complete search history.

(56) References Cited

U.S. PATENT DOCUMENTS 4,239,273 A * 12/1980 Dodemont ..... B66C 3/005 415/182.1
4,333,676 A * 6/1982 Thumm ..... B66C 13/08 294/68.23
5,048,295 A * 9/1991 Hoscheler ..... F15B 11/0445 60/459
5,395,519 A * 3/1995 Miller ..... B01D 35/26 210/149
5,493,860 A * 2/1996 Bjerke ..... F15B 21/005 60/327
5,533,333 A * 7/1996 Pullar ..... B60T 17/02 60/327
6,666,655 B2 * 12/2003 Heath ..... F04B 23/08 417/53
6,912,803 B2 * 7/2005 Ichimura ..... F15B 19/005 37/348
7,712,232 B2 * 5/2010 Majkrzak ..... E01H 5/098 37/245
9,157,527 B2 * 10/2015 Thorell ..... F16H 61/4096
9,618,015 B2 * 4/2017 Morselli ..... F15B 1/26
2002/0000158 A1 1/2002 Ennemark et al.
2002/0036016 A1 3/2002 Ennemark et al.
2004/0168435 A1 * 9/2004 Ichimura ..... F15B 19/005 60/403
2006/0032222 A1 * 2/2006 Slattery ..... F15B 11/0445 60/500
2010/0205953 A1 * 8/2010 Bettin ..... A01C 7/081 60/455
2014/0026969 A1 1/2014 Helbig et al.
2014/0208728 A1 7/2014 Ma et al.
2015/0128584 A1 * 5/2015 Zaleski ..... F15B 21/10 60/459
2015/0247511 A1 * 9/2015 Barr ..... F15B 1/26 60/327

OTHER PUBLICATIONS

International Search Report for International Application No. PCT/IB2016/051223 issued by the European Patent Office dated Jun. 17, 2016.

* cited by examiner

HYDRAULIC EQUIPMENT FOR EXCAVATORS AND OPERATING MACHINES IN GENERAL

RELATED APPLICATIONS

The present application is a U.S. national phase application of International Application No. PCT/IB2016/051223 filed Mar. 4, 2016, which claims the benefit of priority to Italian Patent Application No. 102015000007543, filed on Mar. 4, 2015, the contents of which are incorporated in this application by reference.

TECHNICAL FIELD

The present invention relates to hydraulic equipment, such as for example a screening basket or a rotary separator, comprising a hydraulic motor actuated via a supply circuit connectable to the main hydraulic circuit of an earth-moving machine, such as for example an excavator or a digger.

BACKGROUND OF THE INVENTION

Hydraulically actuated equipment, usable as accessories and comprising one or more implements, is capable of being attached to the arms of excavators and similar operating machines.

An example of such equipment is represented by milling accessories such as milling heads, also known as rotary separators, in which a pair of rotating drums provided with teeth are made to rotate by means of a hydraulic motor.

An example of this type of equipment is described in U.S. Pat. No. 6,626,500.

A further example is represented by screening buckets, such as the one described in patent application EP 284643.

In one embodiment of the present invention, a structure that supports a rotating basket is connected to the arm of the excavating machine. The basket is provided with a mesh structure whose dimensions are such as to allow only the passage of material with dimensions below a predetermined size. The rotation of the basket is obtained by means of a hydraulic motor actuated via the hydraulic circuit of the operating machine.

It is obvious that for the correct functioning of such hydraulic equipment, and generally for equipment that uses a hydraulic motor, it is necessary for there to be a continuous and sufficient delivery of working fluid from the supporting operating machine.

However, as frequently occurs, due to forgetfulness, dirt in the connecting elements of the drainage pipe, damage to the discharge pipe, or the use of incorrect settings on the excavators, there is an irregular or otherwise incorrect supply of the working fluid, causing possible damage to the structure of the hydraulic motor or the need for extraordinary maintenance work. The above-mentioned problems entail a period of inactivity of the machine that translates into a financial expense.

A connection for hydraulic equipment provided with a safety valve is described in U.S. Published Patent Application No. 2002/0036016. However, that document limits itself to proposing the use of a valve for interrupting the flow of a working fluid.

Therefore, the technical problem underlying the present invention is that of providing a hydraulic equipment that makes it possible to obviate the disadvantages mentioned above with reference to the prior art.

SUMMARY OF THE INVENTION

This problem is solved by the hydraulic equipment summarized as follows.

Hydraulic equipment of the type that can be fixed to a moving arm of an operating machine comprises: (1) a support structure connected or connectable to the moving arm of the operating machine and a first hydraulic motor for the rotation of a working element; (2) a feed pipe connected or connectable to a hydraulic circuit of the operating machine to supply a flow of working fluid to the hydraulic motor; and (3) a drainage unit for the drainage of working fluid from the hydraulic motor, the drainage unit having a drainage pipe through which the drained working liquid flows, a pressure detector for detecting, directly or indirectly, the pressure present in the drainage pipe and a shut-off valve operationally associated with the pressure detector in such a way as to interrupt the flow of working fluid in the feed pipe to the hydraulic motor when predetermined pressure conditions are detected by the pressure detector.

Preferred features of the invention are defined in the dependent claims. In one embodiment, the hydraulic equipment may include a pump operating on the flow of working fluid that passes through the drainage pipe. The pump may be actuated by a second hydraulic motor.

In another embodiment, the hydraulic equipment may have a containment tank, which may include a level indicator and/or a plug. A pressure detector may be part of or separate from the containment tank. The shutoff valve is further adapted to interrupt the flow of the working fluid when the height of the working fluid in the containment tank exceeds a certain predetermined level.

The present invention offers some significant advantages. A main advantage lies in the fact that the equipment according to the present invention makes it possible to prevent malfunctions of the equipment so as to avoid or in any event eliminate the need for maintenance due to irregularity in the supply of working fluid delivered or received from the supporting machine.

According to a further aspect, the invention also relates to a hydraulic implement of the type that can be fixed to a moving arm of an operating machine and that includes a rotating working element comprising a support structure connected or connectable to a moving arm of the operating machine and a hydraulic motor for the rotation of said working element and comprising a feed pipe connected or connectable to a hydraulic circuit of the supporting operating machine to supply or receive a flow of working fluid to or from the hydraulic motor and a drainage pipe for the drainage of the working fluid that exits after lubrication of the hydraulic motor to a pump that operates on the flow of operating fluid that passes through said drainage pipe, sucking up said working fluid and driving it at high pressure towards the drainage pipe.

According to this aspect of the invention, although the flow of the working fluid is not interrupted, but rather slowed by increasing the pressure in the drainage pipe, the pump makes it possible to increase the drainage capacity of the drainage pipe, thus enhancing the ability to withstand high pressures that could damage the hydraulic motor.

Preferably, according to one embodiment, the hydraulic equipment further comprises a second motor, which may be hydraulic or electric, for actuating said pump.

Moreover, according to a preferred embodiment, the two hydraulic motors are connected to each other in series.

It is to be understood that both the foregoing general description and the following detailed description are exemplary, but are not restrictive, of the invention. Other advantages, features and modes of use of the present invention will become apparent from the following detailed description of a number of embodiments, given by way of non-limitative example.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Reference will be made to the figures of the accompanying drawing, wherein.

DETAILED DESCRIPTION OF THE INVENTION

Figure 1:
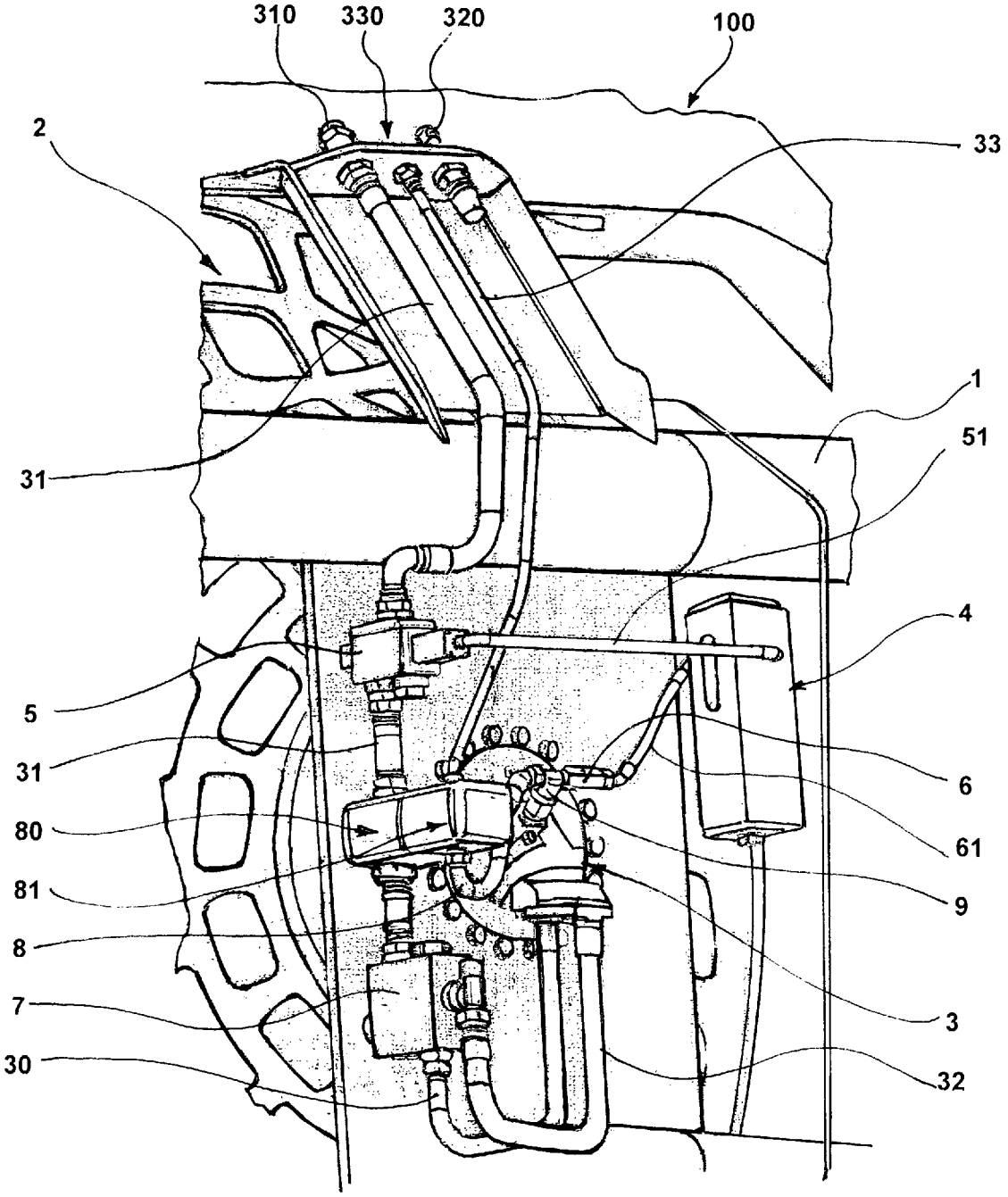
FIG. 1 is a perspective view from the rear of an exemplary embodiment of the present invention.

With reference initially to FIG. 1, hydraulic equipment for an excavator, or more generally for an operating machine, is indicated as a whole by the reference number 100. In one embodiment, the hydraulic equipment is represented by a screening bucket, but as will become evident below, the same principles can also be applied to other types of equipment, such as for example a rotary cutter, a bucket crusher, a rotating shear, a vibro-ripper or deforestation equipment. Therefore, the invention relates in general to all equipment that requires a flow of working fluid under pressure delivered by the operating machine.

As will become more clearly evident below, the hydraulic equipment 100 is of the type suitable to be mounted on a moving arm of the excavator by connecting plates or other equivalent coupling means.

As mentioned previously, in the present embodiment the hydraulic equipment 100 comprises an outer casing 1, which defines a support structure on which a working element (e.g., a screening basket) 2 is rotatably supported.

The working element 2 is then driven in rotation by a hydraulic motor 3, also connected to the support structure 1. Also in the light of the above, the same principles can also be applied to different pieces of hydraulic equipment that comprise, in general, a working element 2 actuated by a hydraulic motor 3.

Figure 2:
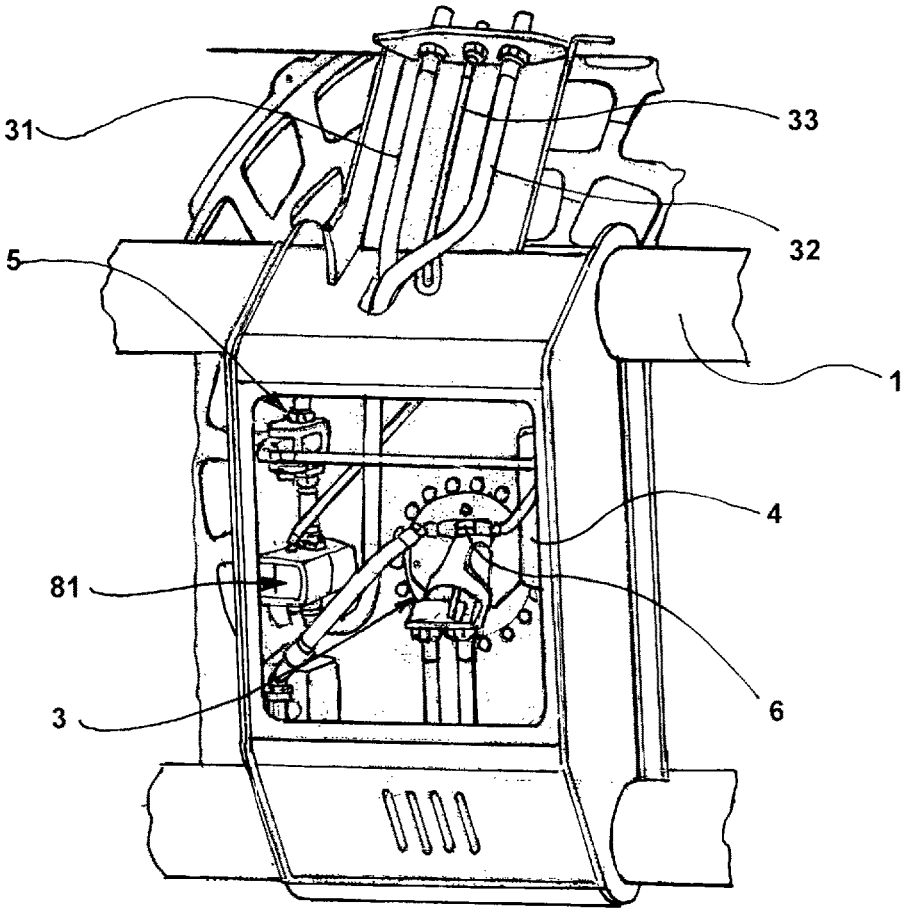
FIG. 2 is a perspective view from the rear of an exemplary embodiment of the present invention.
Figure 3:
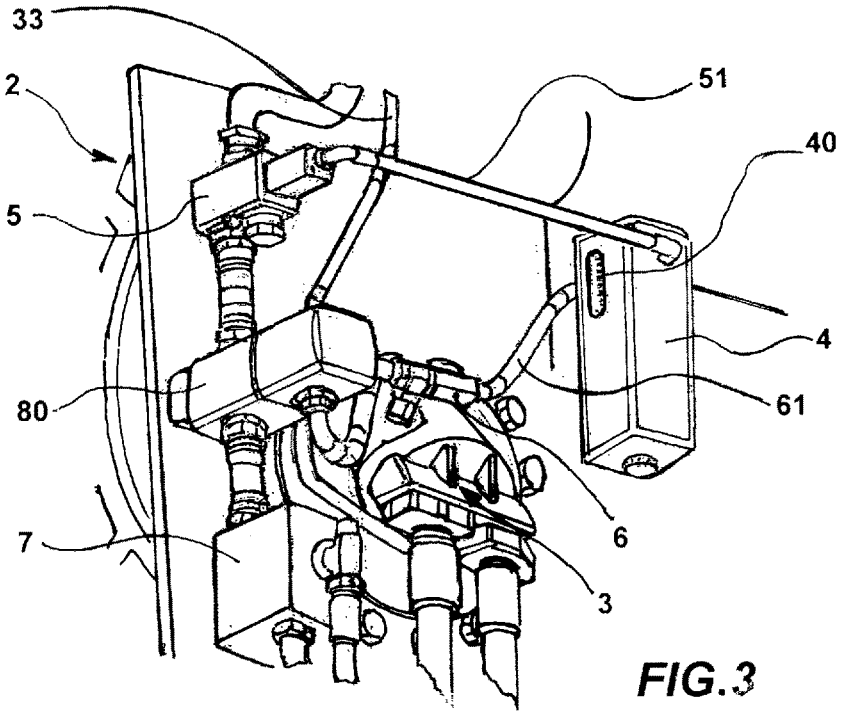
FIG. 3 is a perspective view from the rear of an exemplary embodiment of the present invention.
Figure 4:
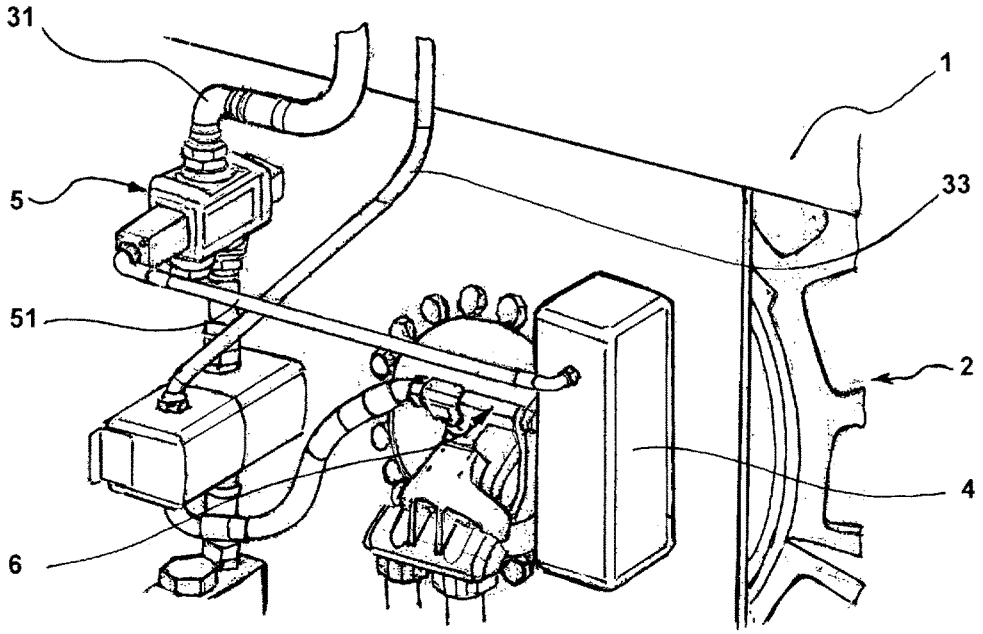
FIG. 4 is a perspective view from the rear of an exemplary embodiment of the present invention.
Figure 5:
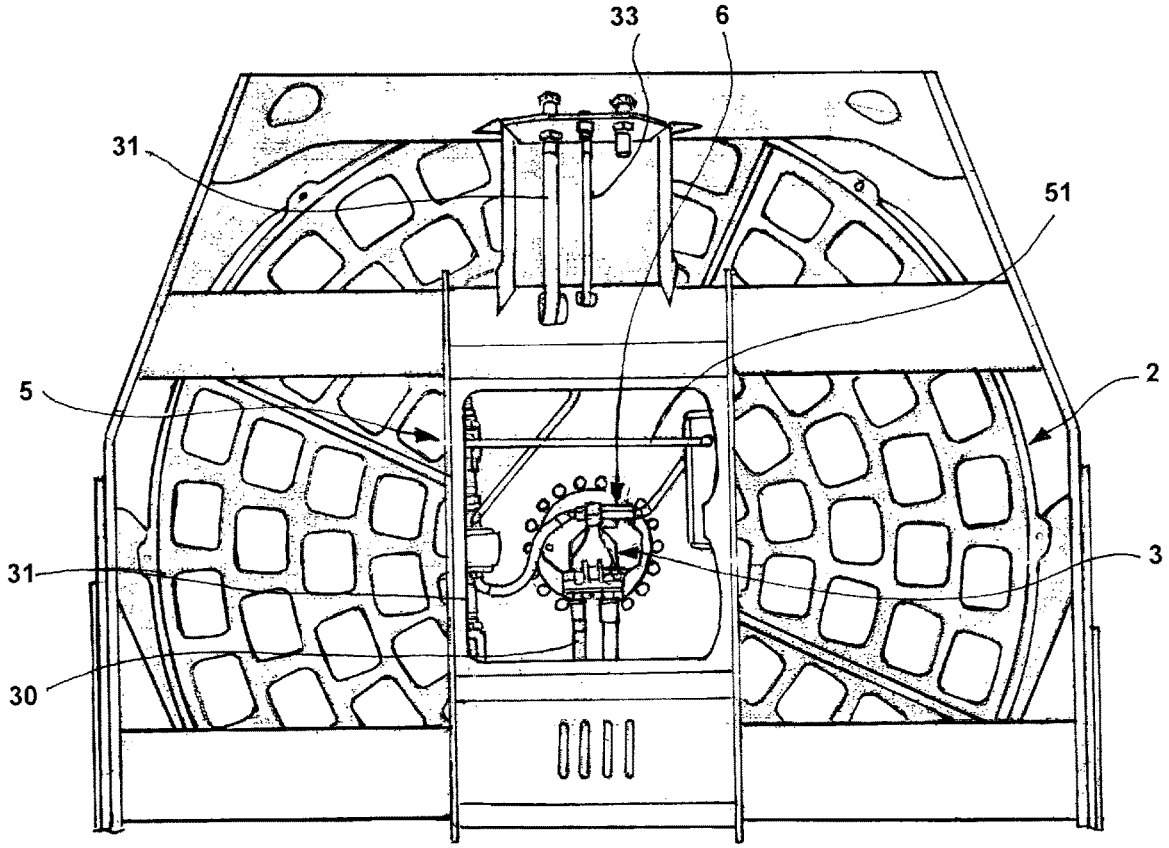
FIG. 5 is a perspective view from the rear of an exemplary embodiment of the present invention.

The actuation of the hydraulic motor 3 takes place by a working fluid supplied by the machine that is fed through a feed pipe 31 and returned into the hydraulic circuit of the machine by a return pipe 32, the latter being illustrated for example in FIG. 2 and not represented in some of the other figures for the sake of greater clarity.

In addition to the feed pipe 31 and the return pipe 32, the hydraulic equipment 100 according to the present invention further comprises a drainage pipe 33, connected to the hydraulic motor 3 via a connecting pipe 8 and, preferably, a suction pump 81.

The drainage pipe 33 and connecting pipe 8, together with the suction pump 81, form a drainage unit intended for the drainage of small amounts of working fluid from the hydraulic motor 3 for maintaining the characteristics suitable for the operation of the hydraulic motor 3 in a manner that will be described in greater detail below.

According to a preferred embodiment, the feed 31, return 32, and drainage 33 pipes are provided with respective connecting elements 310, 320 and 330 which allow connection with the hydraulic circuit of the supporting operating machine.

In this way, the working fluid is introduced via the feed pipe 31 and then delivered to the hydraulic motor 3 through a second feed portion 30 and a flow regulator 7. According to a preferred embodiment, along this path, the fluid also passes through a second motor 80 which drives the suction pump 81, in a manner that will be described in greater detail below.

In normal operation, the working fluid is introduced into the hydraulic motor 3 via the second feed portion 30, from where it is mainly made to flow out towards the return pipe 32 and to a lesser extent is made to flow out through the connecting pipe 8 to the suction pump 81 and the drainage pipe 33 for the fluid intended for lubricating the bushes of the hydraulic motor 3.

The second motor 80, actuated by the fluid from the feed pipe 31, actuates the suction pump 81, which acts by sucking the excess fluid flow present in the drainage outlet of the hydraulic motor 3, intended for the connecting pipe 8. Therefore, the fluid emerging from the drainage of the hydraulic motor 3 that is discharged into the suction pump 81 and then driven by the suction pump 81 towards the drainage pipe connection 330 of the supporting machine via the drainage pipe 33 will, in the event of excess pressure, be sucked up and sent to its own discharge thanks to the assistance of the suction pump 81. Thus, any abnormal pressures resulting from any malfunction of the supporting machine are overcome. The suction pump 81 therefore operates on the flow of working fluid that passes through the drainage pipe 33, increasing the capacity for discharging the pressure present in the drainage pipe 33 and consequently avoiding damage to the hydraulic motor 3 of the hydraulic equipment 100.

In this way, in the connector pipe 8 and in the hydraulic motor 3 in the flow outlet 9 there will be a low back-pressure that is normally below the level that might cause damage to said hydraulic motor 3, provided there are no substantial or particularly long-lasting problems.

It should, however, be noted that the equipment created according to the prior art have motors with predetermined operating characteristics which must therefore be respected, particularly with regard to the pressure and flow rate of fluid ejected into the drainage pipe 33.

In order therefore to prevent the actuation of the hydraulic motor 3 under pressure and/or flow rate conditions that are not compatible with its normal functioning, the hydraulic equipment 100 according to the present invention comprises a shut-off valve 5 capable of shutting off the feed pipe 31 in such a way as to interrupt the flow of working fluid to the hydraulic motor 3 if the suction pump 81 does not succeed in maintaining the appropriate operating characteristics in terms of fluid and pressure in the drainage pipe 33 and in the successive drainage pipe connection 330 that connects the equipment to the drainage discharge.

The hydraulic equipment 100 further comprises a pressure detector 6, operationally associated with the shut-off valve 5, that directly or indirectly detects the pressure present within the drainage pipe 33.

In this way, the shut-off valve 5 can be advantageously controlled according to the pressure conditions that occur in the drainage pipe 33, thus ensuring that operation takes place exclusively in optimal conditions for the hydraulic motor 3.

In other words, upon the achievement of the predetermined conditions within the drainage pipe 33, preferably relating to the pressure within the same, the shut-off valve 5 is actuated in such a way as to close the feed pipe 31, interrupting the flow of working fluid to the hydraulic motor 3.

As will become more clearly apparent below, the predetermined conditions under which the flow of working fluid is interrupted depend on the specific application, but generally speaking are linked to the occurrence of excess pressure in a part of the hydraulic motor 3 which, if it were to exceed certain limits, could cause damage to the hydraulic motor 3 or give rise to the need for maintenance.

The shutting-off of the feed pipe 31 and the consequent interruption of the flow of working fluid instead makes it possible to lock the hydraulic motor 3 almost instantaneously and avoid, or at least considerably reduce, the risk of damage or the occurrence of other problems.

In another embodiment, the hydraulic equipment 100 further comprises a containment tank 4 into which the working fluid leaving the hydraulic motor 3 is sent when particular operating conditions occur, in particular when a predetermined pressure value is achieved within the drainage pipe 33 and the connecting pipe 8. In one embodiment, the containment tank 4 is formed as a separate unit with respect to the pressure detector 6.

To this end, the drainage pipe 33 is further provided with a pressure detecting valve which, upon the achievement of a predetermined pressure value, diverts the flow of working fluid to the containment tank 4 via a diversion pipe 61. It is therefore evident that in the present embodiment, the pressure detecting valve defines the pressure detector 6, which consequently has two separate bodies.

The containment tank 4, which is normally empty, will therefore begin to be filled at the moment when the pressure detecting valve diverts the flow of working fluid upon the achievement of the predetermined pressure.

The hydraulic equipment 100 according to the present invention further comprises the shut-off valve 5.

The shut-off valve 5 is operationally associated with the containment tank 4 in such a way as to interrupt the flow of working fluid in said feed pipe 31 when said containment tank 4 is filled above a predetermined level.

This configuration makes it possible to prevent the hydraulic motor 3 from operating at excessive pressure, since if this were to occur, and the drainage pipe 33 were therefore no longer capable of compensating for the excess pressure, the opening of the pressure detecting valve would cause a flow of fluid towards the containment tank 4.

If excessive pressure occurs for a sufficiently long period of time for the containment tank 4 to be filled to a predetermined level, the shut-off valve 5 makes it possible to block the feed of working fluid, thereby interrupting the operation of the hydraulic motor 3 and so avoiding possible damage due to excess pressure.

Advantageously, the use of the containment tank 4 also makes it possible to avoid any stoppage of the machine if the excessive pressure is present only temporarily, since a certain amount of time is required for the filling of the containment tank 4. This advantage is also provided by the use of a containment tank 4 separate from the pressure detector 6, since it would otherwise be necessary, in order to have sufficient time to avoid stoppage in the event of temporary excess pressure, to create special valves that would be unlikely to function adequately. The valves typically used have rather short response times that do not make it possible to obtain the function described above.

Figure 8:
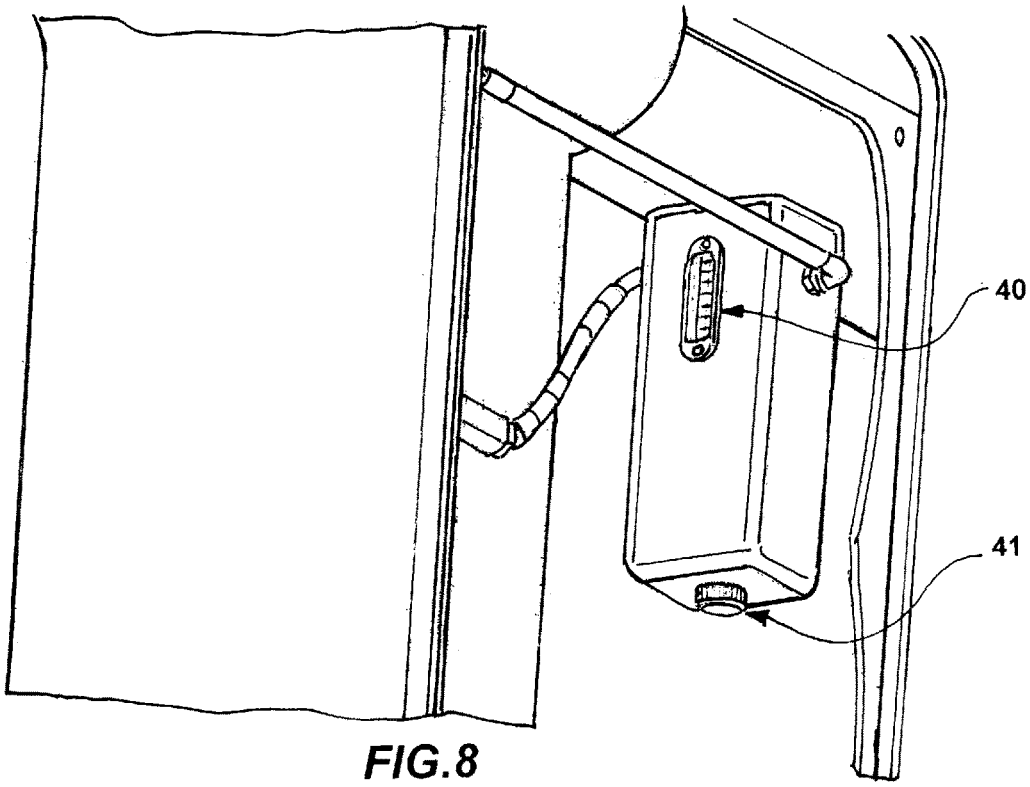
FIG. 8 is a perspective view of a containment tank, particularly of the hydraulic equipment according to the present invention.

According to a preferred embodiment, the containment tank 4 comprises a level indicator 40 illustrated in FIG. 8, placed in such a position as to be visible to an operator. This makes it possible to easily determine that the stoppage of the hydraulic equipment 100 is due to excessive pressure and not to any other factors.

Additionally, according to a preferred embodiment, the containment tank 4 comprises a removable plug 41 located on the bottom of the same, which allows the containment tank 4 to be drained once the problem has been identified and normal operation of the hydraulic equipment 100 has been restored.

In this regard, it should be noted that problems of the type described above often occur for extremely trivial reasons, such as improper connection of the feed pipe 31, return pipe 32, or drainage pipe 33. Therefore the present invention makes it possible, particularly in these cases, to avoid damage to the hydraulic equipment 100 and, thanks also to the presence of the removable plug 41, to resume normal operation without the need for any special intervention.

In the present embodiment, therefore, if the action of the suction pump 81 is not sufficient, the presence of the shut-off valve 5 controlled by the pressure detector 6, connected to the diversion pipe 61, and of the containment tank 4 with a second connecting pipe 51, will cause the closure of the shut-off valve 5 in the manner previously described, interrupting the flow and pressure in the second feed portion 30.

Figure 7:
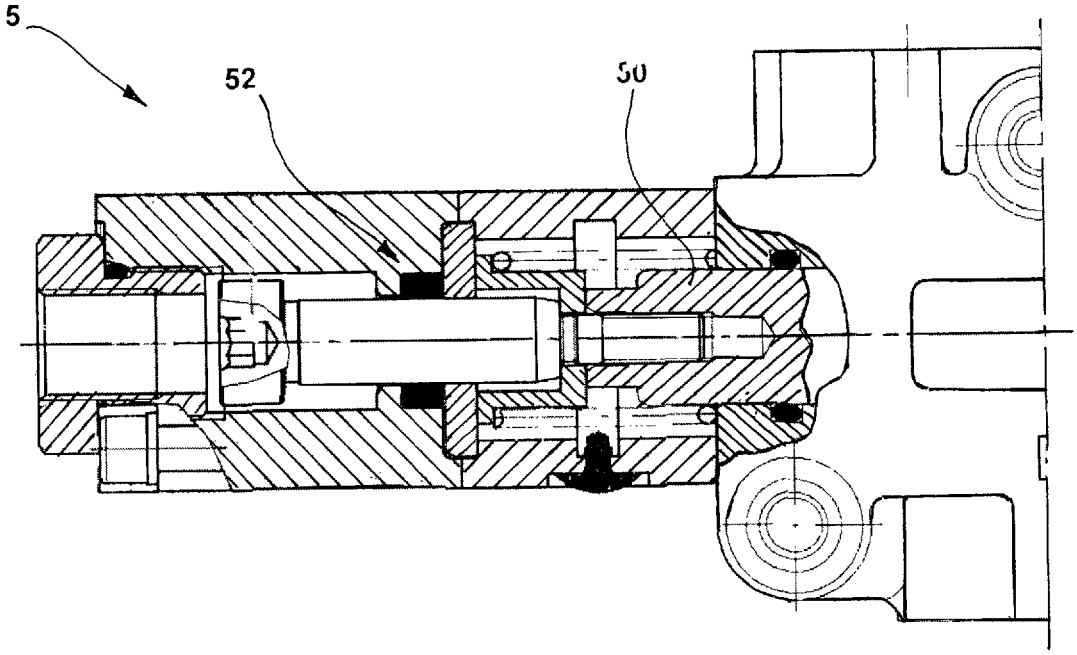
FIG. 7 is a cross section view of a shut off valve of an exemplary embodiment of the present invention.

According to a preferred embodiment, illustrated in detail in FIG. 7, the shut-off valve 5 is of the type comprising a slider 50 that is movable between a first position wherein the passage of fluid is permitted and a second position wherein the flow is interrupted.

Figure 6:
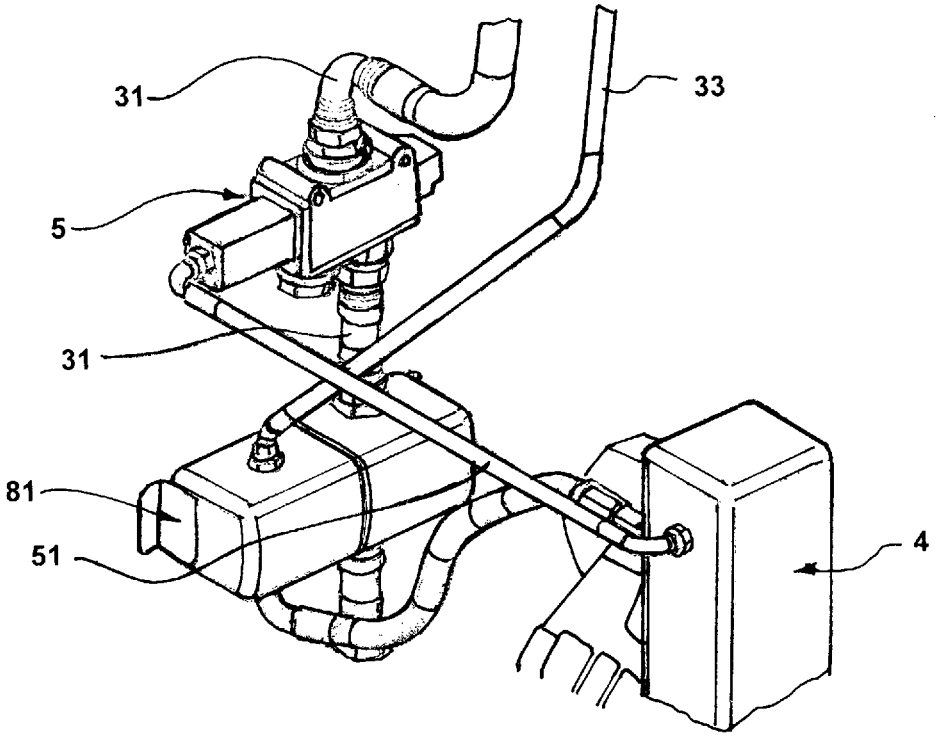
FIG. 6 is a perspective view of a shut-off valve of an exemplary embodiment of the present invention.

With reference also to FIG. 6, a second connecting pipe 51 extends between the containment tank 4 and the shut-off valve 5 in such a way as to supply said valve 5 with a flow of fluid when the content of working fluid within the tank 4 achieves the required level.

FIG. 7 shows a schematic representation of the shut-off valve 5 in a first embodiment, in which the working fluid supplied through the second connecting pipe 51 acts on a thrust surface 52 of a slider 50 in such a way as to move it from the first position to the second position.

Figure 9:
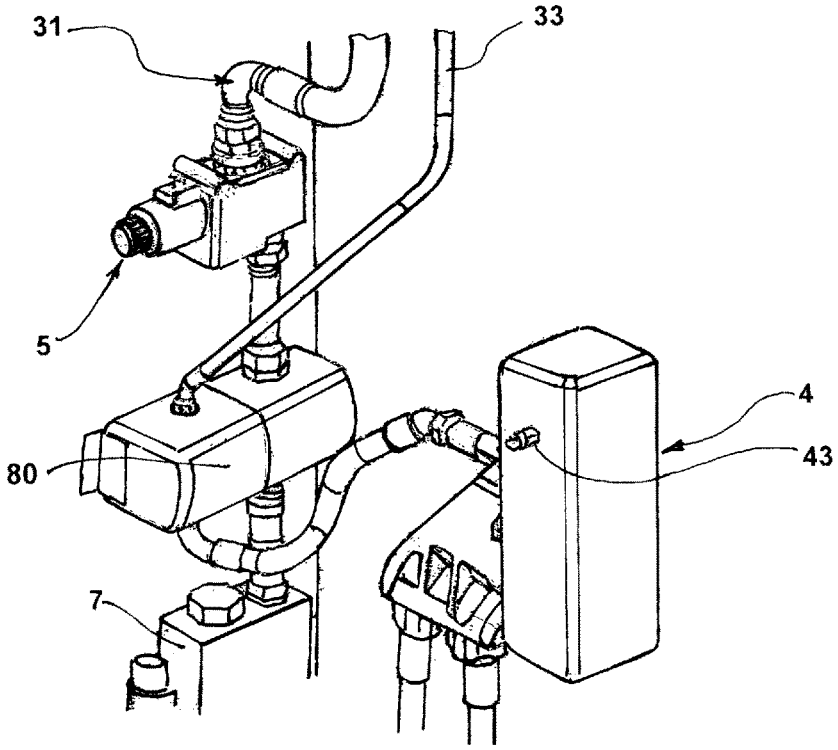
FIG. 9 is a perspective view that illustrates in detail a shut-off valve of one embodiment of the hydraulic equipment according to the present invention.
Figure 10:
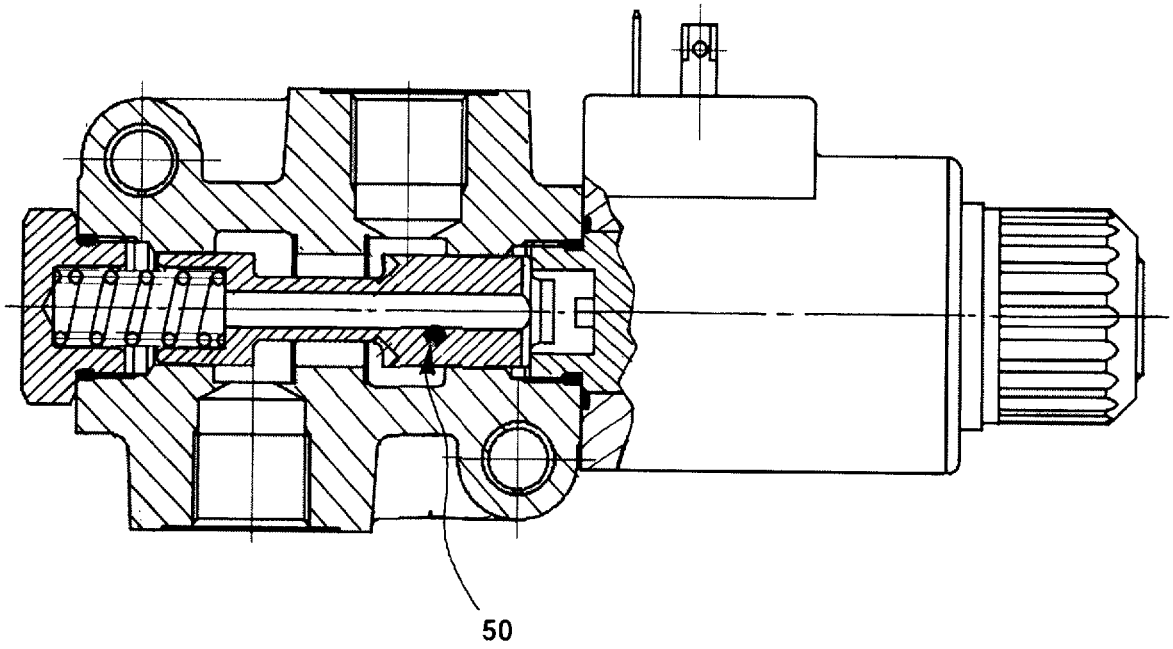
FIG. 10 is a cross section view that illustrates in detail a shut-off valve of one embodiment of the hydraulic equipment according to the present invention.

In an alternative embodiment, illustrated with reference to FIGS. 9 and 10, the shut-off valve 5 is controlled electrically.

For this purpose, the containment tank 4 comprises a pressure switch 43 capable of transmitting an activation signal for the movement of the slider 50 from the first operating position to the second operating position upon the achievement of a predetermined pressure within said containment tank 4, corresponding to the predetermined level of filling.

The invention therefore solves the identified problem, while simultaneously providing numerous advantages, including the ability to automatically block the operation of the hydraulic equipment 100 before any substantial damage can occur.

Furthermore, once the problem has been identified, the hydraulic equipment 100 according to the present invention can be easily restored to its normal operation.

Finally, the solution adopted requires only minimal construction modifications with respect to the known solutions, and uses components of modest cost.

The invention claimed is:

1. Hydraulic equipment of the type that can be fixed to a moving arm of an operating machine, the hydraulic equipment comprising:

a support structure connected or connectable to the moving arm of the operating machine and a first hydraulic motor for the rotation of a working element;

a feed pipe connected or connectable to a hydraulic circuit of the operating machine to supply a flow of working fluid to the first hydraulic motor;

a return pipe by which the flow of working fluid is returned into the hydraulic circuit of the operating machine; and a drainage unit for the drainage of working fluid from said first hydraulic motor, said drainage unit having a drainage pipe through which the drained working liquid intended for lubricating the bushes of the first hydraulic motor flows, a pressure detector adapted to detecting, directly or indirectly, the pressure present in said drainage pipe and a shut-off valve operationally associated with said pressure detector in such a way as to interrupt the flow of working fluid in said feed pipe to said first hydraulic motor when predetermined pressure conditions are detected by said pressure detector, and a containment tank which is connected to said drainage unit in such a way as to cause the filling of said containment tank upon the achievement of a predetermined pressure of the operating fluid, and said shut-off valve is further adapted to interrupt the flow of working fluid to said first hydraulic motor when said containment tank is filled above a predetermined level, thereby interrupting the operation of the first hydraulic motor, wherein said pressure detector comprises a pressure detecting valve connected to said containment tank via a deviation pipe in such a way that upon the achievement of a predetermined pressure value, the flow of working fluid is diverted to said containment tank by said deviation pipe, the containment tank being normally empty and beginning to be filled at the moment when the pressure detecting valve diverts the flow of working fluid upon the achievement of the predetermined pressure.

2. The equipment according to claim 1, wherein said drainage unit further comprises a pump, said pump operating on the flow of working fluid that passes through said drainage pipe.

3. The hydraulic equipment according to claim 2, further comprising a second hydraulic motor for actuating said pump.

4. The hydraulic equipment according to claim 3, wherein said first hydraulic motor and said second hydraulic motor are connected in series.

5. The hydraulic equipment according to claim 1, wherein said containment tank is formed as a separate unit with respect to said pressure detector.

6. The hydraulic equipment according to claim 5, wherein said containment tank further comprises a level indicator.

7. The hydraulic equipment according to claim 1, wherein said shut-off valve comprises a slider movable between a first position wherein the passage of fluid is permitted and a second position wherein the flow is interrupted.

8. The hydraulic equipment according to claim 7, further comprising a connecting pipe that connects a containment tank and said shut-off valve and is adapted to deliver a flow of fluid, upon the achievement of a predetermined level in the containment tank, to a thrust surface of said slider in such a way as to move the slider from said first position to said second position.

9. The hydraulic equipment according to claim 8, wherein said slider is controlled electrically, and said containment tank further comprises a pressure switch capable of transmitting an activation signal for the movement of said slider from said first position to said second position upon the achievement of a predetermined pressure within said containment tank corresponding to said predetermined level of filling.

10. The hydraulic equipment according to claim 1, wherein said containment tank comprises a removable plug located on a bottom wall of the containment tank for the emptying of the same.

11. The hydraulic equipment according to claim 1, wherein said containment tank further comprises a level indicator.

12. The hydraulic equipment according to claim 11, wherein said level indicator is placed in such a position as to be visible to an operator.

13. The hydraulic equipment according to claim 11, wherein said level indicator is formed by a window showing the level of filling of the containment tank.

14. Hydraulic equipment of the type that can be fixed to a moving arm of an operating machine, the hydraulic equipment comprising:

a support structure connected or connectable to the moving arm of the operating machine and a first hydraulic motor for the rotation of a working element;

a feed pipe connected or connectable to a hydraulic circuit of the operating machine to supply a flow of working fluid to the hydraulic motor;

a return pipe by which the flow of working fluid is returned into the hydraulic circuit of the operating machine; and a drainage unit for the drainage of working fluid from said hydraulic motor, said drainage unit having a drainage pipe through which the drained working liquid intended for lubricating the bushes of the hydraulic motor flows, a pressure detector adapted to detecting, directly or indirectly, the pressure present in said drainage pipe, a shut-off valve having a slider movable between a first position wherein the passage of fluid is permitted and a second position wherein the flow is interrupted and being operationally associated with said pressure detector in such a way as to interrupt the flow of working fluid in said feed pipe to said hydraulic motor when predetermined pressure conditions are detected by said pressure detector, and a pump operating on the flow of working fluid that passes through said drainage pipe; and a containment tank which is formed as a separate unit with respect to said pressure detector and is connected to said drainage unit in such a way as to cause the filling of said containment tank upon the achievement of a predetermined pressure of the operating fluid, the containment tank having a level indicator and a removable plug located on a bottom wall of the containment tank for the emptying of the same, and said shut-off valve is further adapted to interrupt the flow of working fluid to said first hydraulic motor when said containment tank is filled above a predetermined level, thereby interrupting the operation of the hydraulic motor, wherein said pressure detector comprises a pressure detecting valve connected to said containment tank via a deviation pipe in such a way that upon the achievement of a predetermined pressure value, the flow of working fluid is diverted to said containment tank by said deviation pipe, the containment tank being normally empty and beginning to be filled at the moment when the pressure detecting valve diverts the flow of working fluid upon the achievement of the predetermined pressure.

15. The hydraulic equipment according to claim 14, further comprising a second hydraulic motor for actuating said pump.

16. The hydraulic equipment according to claim 15, wherein said first hydraulic motor and said second hydraulic motor are connected in series.

17. The hydraulic equipment according to claim 14, further comprising a connecting pipe that connects a containment tank and said shut-off valve and is adapted to deliver a flow of fluid, upon the achievement of a predetermined level in the containment tank, to a thrust surface of said slider in such a way as to move the slider from said first position to said second position.

18. The hydraulic equipment according to claim 17, wherein said slider is controlled electrically, and said containment tank further comprises a pressure switch capable of transmitting an activation signal for the movement of said slider from said first position to said second position upon the achievement of a predetermined pressure within said containment tank corresponding to said predetermined level of filling.

19. The hydraulic equipment according to claim 14, wherein said level indicator is placed in such a position as to be visible to an operator.

20. The hydraulic equipment according to claim 14, wherein said level indicator is formed by a window showing the level of filling of the containment tank.

* * * * *